US005208141A

United States Patent [19]

Ikesu et al.

[11] Patent Number: 5,208,141

[45] Date of Patent: May 4, 1993

[54] SILVER HALIDE COLOR PHOTOGRAPHIC LIGHT-SENSITIVE MATERIAL

[75] Inventors: Satoru Ikesu; Hiroshi Kita; Yutaka Kaneko, all of Hino, Japan

[73] Assignee: Konica Corporation, Tokyo, Japan

[21] Appl. No.: 771,447

[22] Filed: Oct. 4, 1991

[30] Foreign Application Priority Data

| | | | |
|---|---|---|---|
| Oct. 9, 1990 | [JP] | Japan | 2-270980 |
| Oct. 10, 1990 | [JP] | Japan | 2-271537 |
| Oct. 17, 1990 | [JP] | Japan | 2-278769 |
| Oct. 17, 1990 | [JP] | Japan | 2-278770 |

[51] Int. Cl.[5] ..... G03C 7/38

[52] U.S. Cl. ..... 430/558; 430/384; 430/385

[58] Field of Search ..... 430/384, 385, 558

[56] References Cited

U.S. PATENT DOCUMENTS 4,950,585 8/1990 Tachibana et al. ..... 430/385

FOREIGN PATENT DOCUMENTS 2304438 12/1990 Japan ..... 430/558

*Primary Examiner*—Lee C. Wright

*Attorney, Agent, or Firm*—Frishauf, Holtz, Goodman & Woodward

[57] ABSTRACT

A silver halide color photographic light-sensitive material is disclosed, in which dye images having a high fastness against heat, moisture and light. The light-sensitive material comprises a support having there on a silver halide emulsion layer containing a coupler represented by the following formula I;

(I)

wherein Za is a —C= group or a —C= group, Zb is a nitrogen atom or a group and Zc is a nitrogen atom or a group, provided that when Zb is a nitrogen atom, Za and Zc are the group and the group, respectively, and when Zc is a nitrogen atom, Za and Zb are the group and the group, respectively; $R_1$, $R_2$, $R_3$, $R_4$, $R_5$, $R_6$ and Y are each a hydrogen atom or a substituent; X is a hydrogen atom or a substituent capable of splitting off upon reaction with the oxydation product of a color developing agent; n and m are each 1 or 0, provided that m+n is 1.

8 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, particularly to a silver halide color photographic light-sensitive material capable of forming dye images having a high fastness against heat moisture and light.

BACKGROUND OF THE INVENTION

By subjecting an exposed silver halide photographic light-sensitive material to color development, an oxidized aromatic primary amine color developing agent is allowed to react with a dye-forming coupler to form a dye in an exposed area, and thereby dye images are formed.

In this photographic method, the substractive color process is used for color reproduction, and thus yellow, magenta and cyan dye images are formed.

As photographic couplers to form yellow dye images, there are used, for example, acylacetanilide-type couplers; as magenta dye image forming couplers, for example, pyrazolone-type, ptrazolobenzimidazole-type, pyrazolotriazole-type and indazolone-type couplers are employed; and as cyan dye image forming couplers, there are generally used, for example, phenol-type and naphthol-type couplers.

The dye images obtained as above are desired not to discolor or fade even when exposed to light or kept under high temperature and high humidity conditions over a long time.

However, cyan dye images obtained from phenol-type or naphthol-type couplers are still insufficient in spectral absorption properties, heat resistance, moisture resistance and light fastness. Studies are continued for years to solve these problems, and various proposals have been made including contrivance on subtituents of such couplers, but there has not been obtained any compound which answers all of these problems.

SUMMARY OF THE INVENTION

A first object of the present invention is to provide a silver halide photographic light-sensitive material containing a novel photographic coupler.

A second object of the present invention is to provide a silver halide photographic light-sensitive material capable of forming cyan dye images causing no discoloration when exposed to heat, moisture or light.

The silver halide color photographic light-sensitive material of the invention comprises a support having thereon a silver halide emulsion layer containing a coupler represented by the following Formula I:

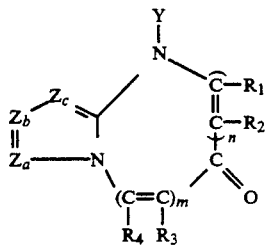

(I)

wherein Za is a

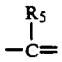

group or a

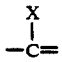

group, Zb is a nitrogen atom or a

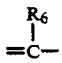

group and Zc is a nitrogen atom or a

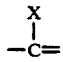

group, provided that when Zb is a nitrogen atom, Za and Zc are the

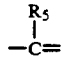

group and the

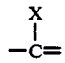

group, respectively, and when Zc is a nitrogen atom, Za and Zb are the

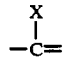

group and the

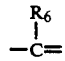

group, respectively; $R_1$, $R_2$, $R_3$, $R_4$, $R_5$, $R_6$ and Y are each a hydrogen atom or a substituent; X is a hydrogen atom or a substituent capable of splitting off upon reaction with the oxidation product of a color developing agent; n and m are each 1 or 0, provided that m+n is 1.

In Formula I, $R_1$, $R_2$, $R_3$, $R_4$, $R_5$ and $R_6$ are each a hydrogen atom or a substituent. The substituents represented by $R_1$ to $R_6$ are not particularly limited in types, but are typically alkyl, aryl, anilino, acylamino, sulfonamido, alkylthio, arylthio, alkenyl and cycloalkyl groups, and other suitable ones include halogen atoms, cycloalkenyl, alkynyl, heterocyclic, sulfonyl, sulfinyl, phosphonyl, acyl, carbamoyl, sulfamoyl, cyano, alkoxy, sulfonyloxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro and sulfone groups, and spiro and bridged hydrocarbon residues.

Among the substituents represented by $R_1$ to $R_6$, the alkyl group is preferably one having 1 to 32 carbon atoms and may be straight-chained or branched.

The aryl group is preferably a phenyl group.

Examples of the acylamino group are alkylcarbonylamino and arylcarbonylamino groups.

Examples of the sulfonamido group include alkylsulfonylamino and arylsulfonylamino groups.

Examples of the alkyl or aryl components in the alkylthio or arylthio groups are alkyl or aryl groups represented by the above $R_1$ to $R_6$.

The alkenyl group is preferably one having 2 to 32 carbon atoms, the cycloalkyl group is preferably one having 3 to 12 carbon atoms, especially 5 to 7 carbon atoms; the alkenyl group may be straight-chained or branched.

The cycloalkenyl group is preferably one having 3 to 12 carbon atoms, especially 5 to 7 carbon atoms.

Examples of the sulfonyl group include alkylsulfonyl and arylsulfonyl groups.

Examples of the sulfinyl group include alkylsulfinyl and arylsulfinyl groups.

Examples of the phosphonyl group include alkylphosphonyl, alkoxyphosphonyl, aryloxyphosphonyl and arylphosphonyl groups.

Examples of the acyl group include alkylcarbonyl and arylcarbonyl groups.

Examples of the carbamoyl group include alkylcarbamoyl and arylcarbamoyl groups.

Examples of the acyloxy group include alkylcarbonyloxy and arylcarbonyloxy groups.

Examples of the carbamoyloxy group include alkylcarbamoyloxy and arylcarbamoyloxy groups.

Examples of the ureido group include alkylureido and arylureido groups.

Examples of the sulfamoylamino group include alkylsulfamoyl and arylsulfamoyl groups.

The heteocyclic group is preferably a five- to seven-membered one; examples thereof include 2-furyl, 2-thienyl, 2-pyrimidinyl, 2-benzothiazolyl, 1-pyrrolyl and 1-tetrazolyl groups.

The heterocyclic oxy group is preferably one having a five- to seven-membered heterocycle; examples thereof include 3,4,5,6-tetrahydropyranyl-2-oxy and 1-phenyltetrazole-5-oxy groups.

The heterocyclic thio group is preferably one having a five- to seven-membered heterocycle; examples thereof include 2-pyridylthio, 2-benzothiazolylthio and 2,4-diphenoxy-1,3,5-triazole-6-thio groups.

Examples of the siloxy group include trimethylsiloxy, triethylsiloxy and dimethylsiloxy groups.

Examples of the imido group include succinimide, 3-heptadecyl succinimido, phthalimido and glutarimido groups.

Examples of the spiro residue include spiro [3,3]heptane-1-yl.

Examples of the bridged hydrocarbon residue include bicyclo[2,2,1]heptane-1-yl, tricyclo[3,3,1,1$^{37}$]decane-1-yl and 7,7-dimethyl-bicyclo[2,2,1]heptane-1-yl.

Among the above substituents, preferred ones as $R_1$ to $R_4$ are alkyl, aryl, carboxyl, oxycarbonyl, cyano, hydroxy, alkoxy, aryloxy, amino, amide and sulfonamide groups, and hydrogen and halogen atoms.

$R_1$ and $R_2$, or $R_3$ and $R_4$ may be linked with each other to form a ring; said ring is preferably a saturated or unsaturated, five-, six-, seven- or eight-membered ring; and examples thereof include benzene, pyridine and quinoline rings.

The above groups may further have a substituent such as an antidiffusing group which may be a long hydrocarbon group or a polymer residue.

Examples of the substituent represented by X and capable of splitting off upon reaction with the oxidation product of a color developing agent include a halogen atom, e.g., chlorine, bromine or fluorine atom, and an alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkyloxythiocarbonylthio, acylamino, sulfonamide, nitrogen-containing heterocycle linked via a nitrogen atom, alkyloxycarbonylaminom aryloxycarbonylamino and carboxyl groups. Among these atoms or groups represented by X, a hydrogen atom and a halogen atom are particularly preferred.

Or Y is a group represented by

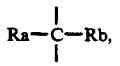

and each of the two bonds of this group may be linked to another coupler nucleus at the bonding position of Y in the coupler nucleus to form a coupler dimer; Ra and Rb are each a hydrogen atom, or an aryl, alkyl or heterocyclic group.

In Formula I, Y represents a hydrogen atom or a substituent; examples of such a substituent, which splits off after the compound of the invention reacts with an oxidation product of a developing agent, are those groups which split off under alkaline conditions as described in Japanese Pat. O.P.I. Pub. No. 228444/1986 and substituents which decouple upon reaction with an oxidation product of a developing agent as described in Japanese Pat. O.P.I. Pub. No. 133734/1981; but Y is preferably a hydrogen atom. Accordingly, preferable couplers represented by the foregoing Formula I are those compounds expressed by the following Formula II-1, II-2, II-3 or II-4.

In Formulas II-1 to II-4, $R_1$, $R_2$, $R_3$, $R_4$, $R_5$, $R_6$ and X are the same as $R_1$ to $R_6$ and X in Formula I, respectively.

Next, typical examples of the compounds according to the invention are illustrated below.

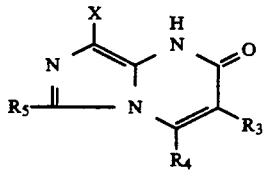

(II-1)

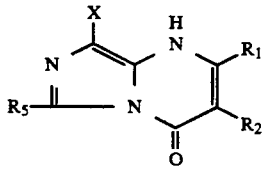

(II-2)

-continued
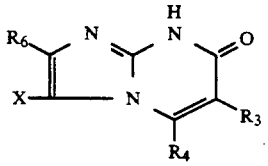
(II-3)
-continued
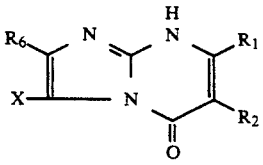
(II-4)

Formula II-1
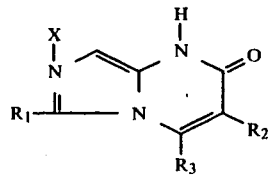
| No. | $R_1$ | $R_2$ | $R_3$ | X |
|---|---|---|---|---|
| 1-1 | $-CH_3$ | H | $CH_3$ | H |
| 1-2 | $-C_3H_7(i)$ | H | $CH_3$ | H |
| 1-3 | $-C_{15}H_{31}$ | H | H | Cl |
| 1-4 | 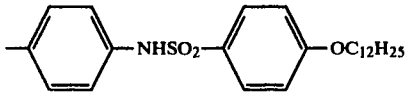 | H | H | H |
| 1-5 | 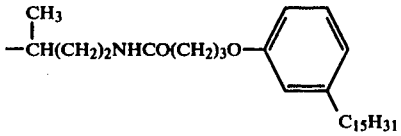 | H | H | Cl |
| 1-6 | 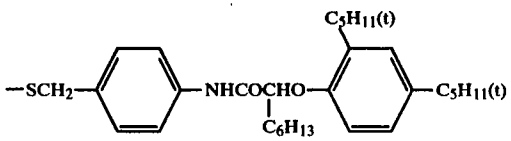 | H | H | Cl |
| 1-7 | 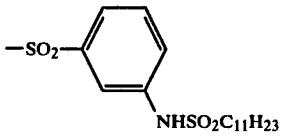 | H | H | H |
| 1-8 | 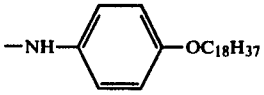 | H | H | Br |
| 1-9 | $-OC_{12}H_{25}$ | H | H | Cl |

-continued
Formula II-1
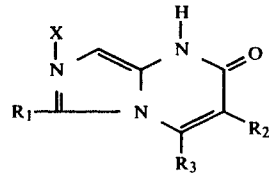
| No. | $R_1$ | $R_2$ | $R_3$ | X |
|---|---|---|---|---|
| 1-10 | 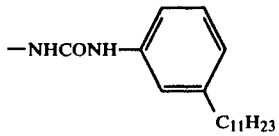 | H | H | H |
| 1-11 | $-CONHC_{12}H_{25}$ | H | H | Cl |
| 1-12 | $-SO_2N(C_8H_{17})_2$ | H | H | H |
| 1-13 | 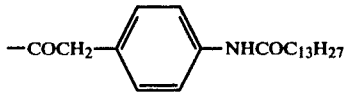 | H | H | Cl |
| 1-14 | H | H | $-OH$ | H |
| 1-15 | H | H | $-OC_{11}H_{23}$ | H |
| 1-16 | $-CH(CH_3)_2$ | H | $-OC_8H_{17}$ | Cl |
| 1-17 | 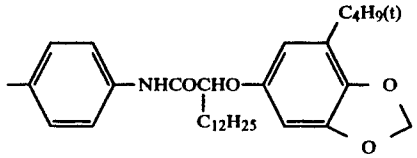 | H | $-OCH_3$ | Cl |
| 1-18 | 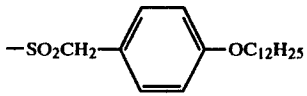 | H | $-OC_2H_5$ | H |
| 1-19 | $-C_{12}H_{25}$ | H | $-OCH_3$ | H |
| 1-20 | $-COOC_{18}H_{37}$ | H | $-OCH_3$ | Cl |
| 1-21 | H | Cl | $-CH_3$ | Cl |
| 1-22 | $-SCH_3$ | Cl | $-CH_3$ | H |

-continued
Formula II-1
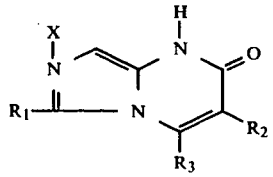
| No. | $R_1$ | $R_2$ | $R_3$ | X |
|---|---|---|---|---|
| 1-23 | 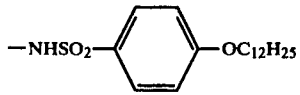 | Cl | $-CH_3$ | H |
| 1-24 | 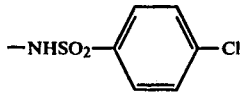 | Cl | $-CH_3$ | H |
| 1-25 | 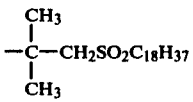 | Cl | $-C_2H_5$ | Cl |
| 1-26 | $-C_{16}H_{33}$ | H | $-C(CH_3)_3$ | 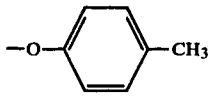 |
| 1-27 | $-NHC_6H_5$ | Br | $-C_{11}H_{23}$ | H |
| 1-28 | 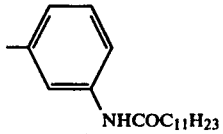 | Cl | $-CH_3$ | H |
| 1-29 | 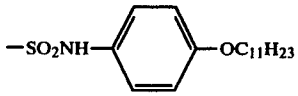 | Cl | $-CH_3$ | H |

-continued
Formula II-1
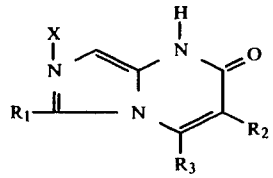
| No. | $R_1$ | $R_2$ | $R_3$ | X |
|---|---|---|---|---|
| 1-30 | 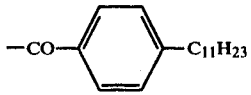 | Cl | $-CH_3$ | H |
| 1-31 | H | H | $-NHSO_2C_{16}H_{33}$ | Cl |
| 1-32 | $-CH_3$ | H | 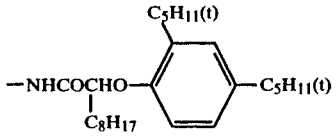 | Cl |
| 1-33 | 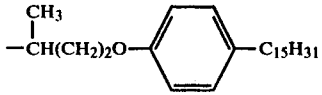 | H | $-NHCOC_4H_9$ | H |
| 1-34 | $-C(CH_3)_3$ | H | 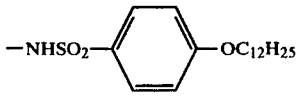 | Cl |
| 1-35 | $-C_{16}H_{33}$ | H | 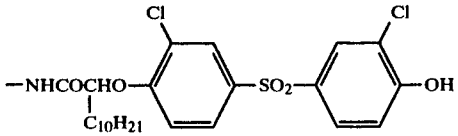 | H |

-continued
Formula II-1
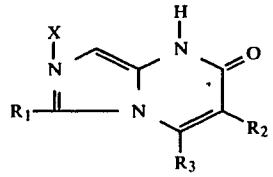
| No. | $R_1$ | $R_2$ | $R_3$ | X |
|---|---|---|---|---|
| 1-36 | $-SO_2CH_2C_6H_5$ | H | 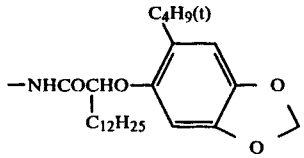 | H |
| 1-37 | $-NHCOCH_3$ | H | 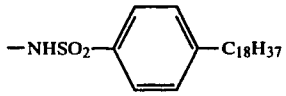 | Cl |
| 1-38 | 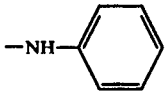 | H | 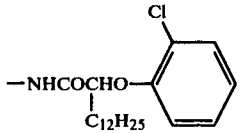 | 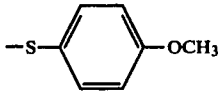 |
| 1-39 | $-OC_2H_5$ | H | 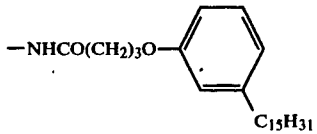 | Cl |
| 1-40 | $-C_6H_5$ | H | $-NHCOC_{11}H_{23}$ | H |
| 1-41 | $-SO_2N(C_3H_7)_2$ | H | 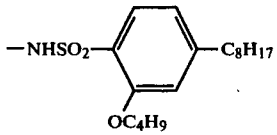 | H |

-continued
Formula II-1
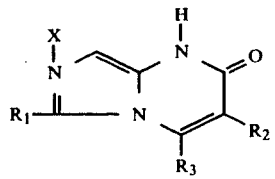
| No. | $R_1$ | $R_2$ | $R_3$ | X |
|---|---|---|---|---|
| 1-42 | $-SO_2NHC_{12}H_{25}$ | H | 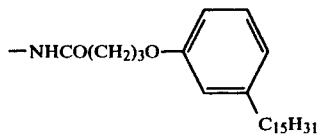 | Cl |
| 1-43 | $-COOCH_3$ | H | $-NHSO_2C_{16}H_{33}$ | 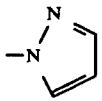 |
| 1-44 | $-COCH_3$ | H | 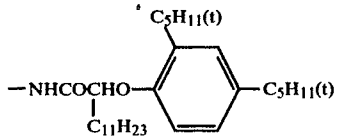 | H |
| 1-45 | 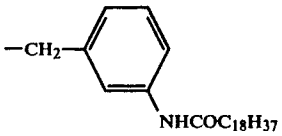 | H | $-NHCOC_2H_5$ | Cl |
| 1-46 | $-CH_3$ | $-C_2H_5$ | 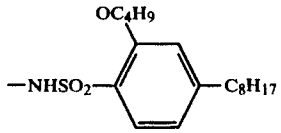 | Cl |

-continued
Formula II-1
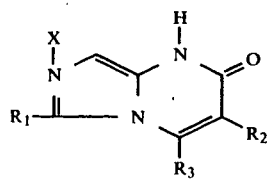
| No. | $R_1$ | $R_2$ | $R_3$ | X |
|---|---|---|---|---|
| 1-47 | $-C_6H_5$ | $-C_8H_{17}$ | 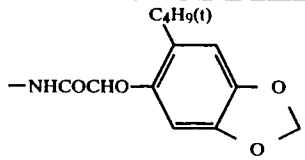 | H |
| 1-48 | $-SO_2N(CH_3)_2$ | H | 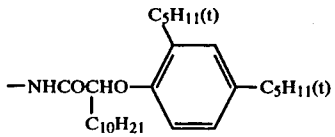 | 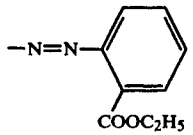 |
| 1-49 | $-NHCOCH_3$ | H | 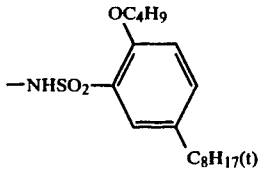 | 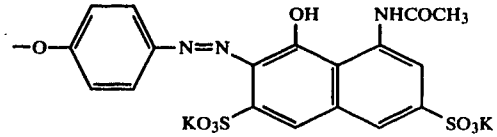 |
| 1-50 | $-C(CH_3)_3$ | H | 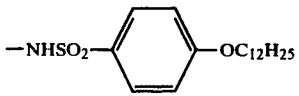 | 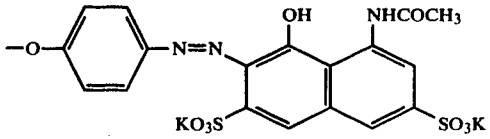 |
| 1-51 | 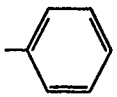 | H | $-CH_3$ | H |

Formula II-2
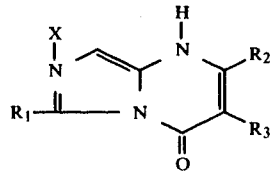
| No. | $R_1$ | $R_2$ | $R_3$ | X |
|---|---|---|---|---|
| 2-1 | $-CH_3$ | $CH_3$ | H | H |
| 2-2 | $-C_3H_7(i)$ | $CH_3$ | H | H |
| 2-3 | $-CH_{15}H_{31}$ | H | H | Cl |
| 2-4 | 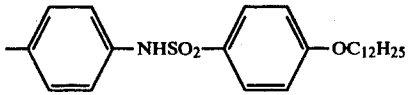 | $CH_3$ | H | H |
| 2-5 | 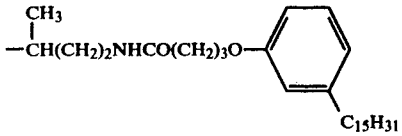 | H | H | Cl |
| 2-6 | 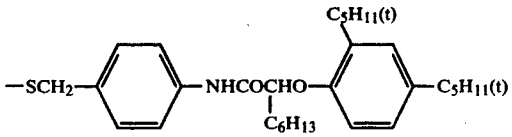 | H | H | Cl |
| 2-7 | 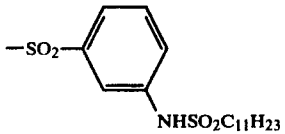 | H | H | H |
| 2-8 | 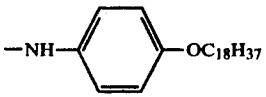 | $CH_3$ | H | Br |
| 2-9 | $-OC_{12}H_{25}$ | H | H | Cl |

-continued
Formula II-2
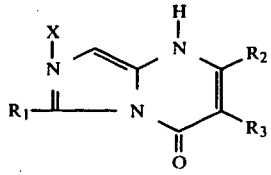
| No. | $R_1$ | $R_2$ | $R_3$ | X |
|---|---|---|---|---|
| 2-10 | 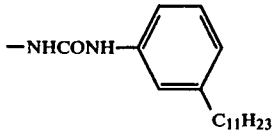 | $C_2H_5$ | H | H |
| 2-11 | $-CONHC_{12}H_{25}$ | $CH_3$ | H | Cl |
| 2-12 | $-SO_2N(C_8H_{17})_2$ | H | H | H |
| 2-13 | 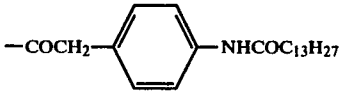 | $CH_3$ | H | Cl |
| 2-14 | H | H | $-OH$ | H |
| 2-15 | H | H | $-OC_{11}H_{23}$ | H |
| 2-16 | $-CH(CH_3)_2$ | H | $-OC_8H_{17}$ | Cl |
| 2-17 | 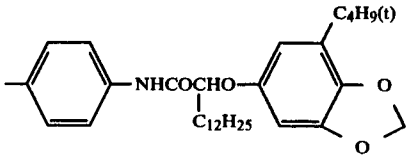 | H | $-OCH_3$ | Cl |
| 2-18 | 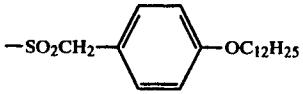 | H | $-OC_2H_5$ | H |
| 2-19 | $-C_{12}H_{25}$ | H | $-OCH_3$ | H |
| 2-20 | $-COOC_{18}H_{37}$ | H | $-OCH_3$ | Cl |
| 2-21 | H | Cl | $-CH_3$ | Cl |
| 2-22 | $-SCH_3$ | Cl | $-CH_3$ | H |

-continued
Formula II-2
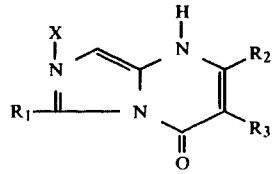
| No. | $R_1$ | $R_2$ | $R_3$ | X |
|---|---|---|---|---|
| 2-23 | $-NHSO_2-C_6H_4-OC_{12}H_{25}$ | Cl | $-CH_3$ | H |
| 2-24 | $-NHSO_2-C_6H_4-Cl$ | Cl | $-CH_3$ | H |
| 2-25 | $-C(CH_3)_2-CH_2SO_2C_{18}H_{37}$ | Cl | $-C_2H_5$ | Cl |
| 2-26 | $-C_{16}H_{33}$ | H | $-C(CH_3)_3$ | $-O-C_6H_4-CH_3$ |
| 2-27 | $-NHC_6H_5$ | Br | $-C_{11}H_{23}$ | H |
| 2-28 | $-C_6H_4-NHCOC_{11}H_{23}$ | Cl | $-CH_3$ | H |
| 2-29 | $-SO_2NH-C_6H_4-OC_{11}H_{23}$ | Cl | $-CH_3$ | H |

-continued
Formula II-2
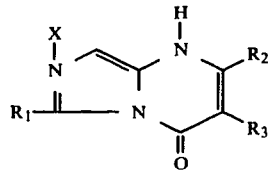
| No. | $R_1$ | $R_2$ | $R_3$ | X |
|---|---|---|---|---|
| 2-30 | 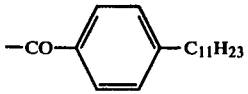 | Cl | $-CH_3$ | H |
| 2-31 | H | H | $-NHSO_2C_{16}H_{33}$ | Cl |
| 2-32 | $-CH_3$ | $CH_3$ | 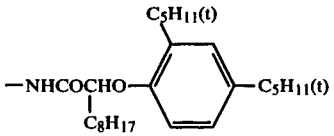 | Cl |
| 2-33 | 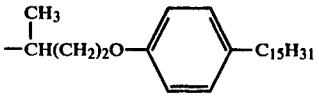 | H | $-NHCOC_4H_9$ | H |
| 2-34 | $-C(CH_3)_3$ | $CH_3$ | 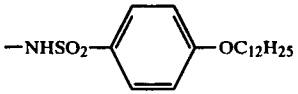 | Cl |
| 2-35 | $-C_{16}H_{33}$ | H | 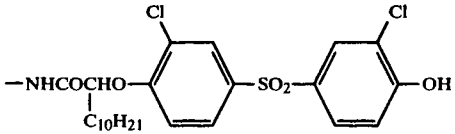 | H |

-continued
Formula II-2
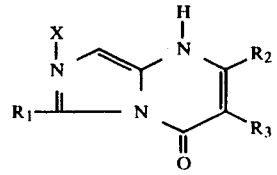
| No. | $R_1$ | $R_2$ | $R_3$ | X |
|---|---|---|---|---|
| 2-36 | $-SO_2CH_2C_6H_5$ | H | 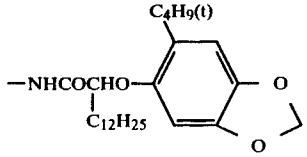 | H |
| 2-37 | $-NHCOCH_3$ | $CH_3$ | 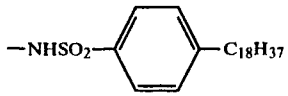 | Cl |
| 2-38 | 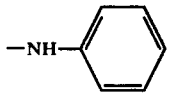 | H | 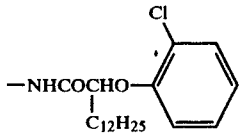 | 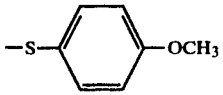 |
| 2-39 | $-OC_2H_5$ | H | 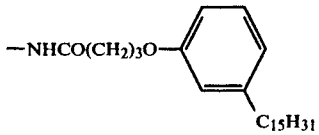 | Cl |
| 2-40 | $-C_6H_5$ | H | $-NHCOC_{11}H_{23}$ | H |
| 2-41 | $-SO_2N(C_3H_7)_2$ | $CH_3$ | 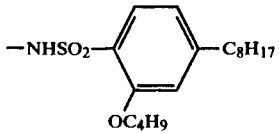 | H |

-continued
Formula II-2
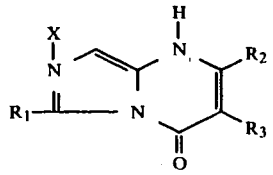
| No. | $R_1$ | $R_2$ | $R_3$ | X |
|---|---|---|---|---|
| 2-42 | $-SO_2NHC_{12}H_{25}$ | $CH_3$ | 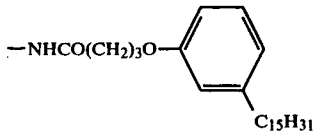 | Cl |
| 2-43 | $-COOCH_3$ | H | $-NHSO_2C_{16}H_{33}$ | 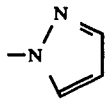 |
| 2-44 | $-COCH_3$ | H | 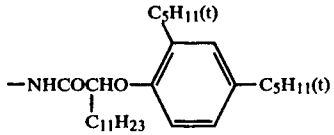 | H |
| 2-45 | 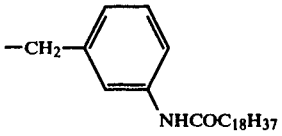 | H | $-NHCOC_2H_5$ | Cl |
| 2-46 | $-CH_3$ | $-C_2H_5$ | 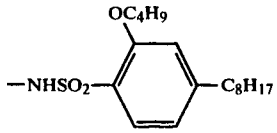 | Cl |

-continued
Formula II-2
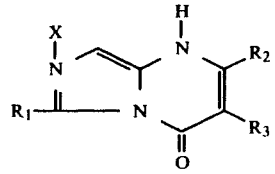
| No. | $R_1$ | $R_2$ | $R_3$ | X |
|---|---|---|---|---|
| 2-47 | $-C_6H_5$ | $-C_8H_{17}$ | 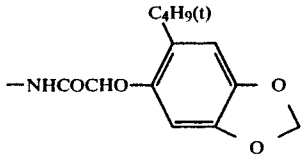 | H |
| 2-48 | $-SO_2N(CH_3)_2$ | $CH_3$ | 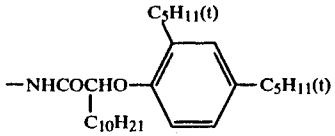 | 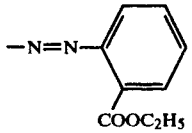 |
| 2-49 | $-NHCOCH_3$ | H | 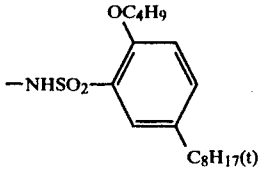 | 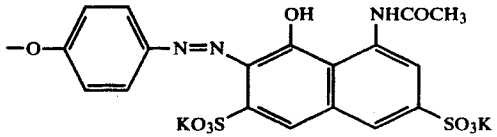 |
| 2-50 | $-C(CH_3)_3$ | $CH_3$ | 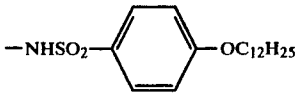 | 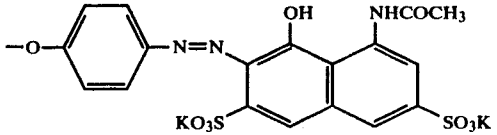 |

Formula II-3
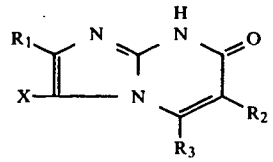
| No. | $R_1$ | $R_2$ | $R_3$ | X |
|---|---|---|---|---|
| 3-1 | $-C_6H_5$ | $-CH_3$ | $-H$ | $-H$ |
| 3-2 | $-CH_3$ | $-CH_3$ | $-H$ | $-H$ |
| 3-3 | $-C_2H_5$ | $-H$ | $-H$ | $-Cl$ |
| 3-4 | $-C_{15}H_{31}$ | $-H$ | $-H$ | $-H$ |
| 3-5 | 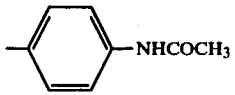 | $-CH_3$ | $-H$ | $-H$ |
| 3-6 | 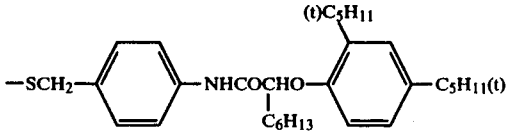 | $-H$ | $-H$ | $-Cl$ |
| 3-7 | 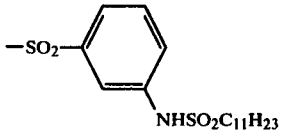 | $-H$ | $-H$ | $-H$ |
| 3-8 | 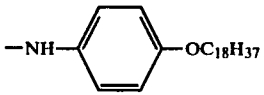 | $-H$ | $-H$ | $-Br$ |
| 3-9 | $-OC_{12}H_{25}$ | $-H$ | $-H$ | $-Cl$ |
| 3-10 | 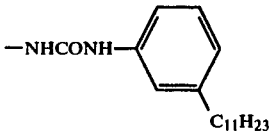 | $-H$ | $-H$ | $-H$ |

-continued
Formula II-3
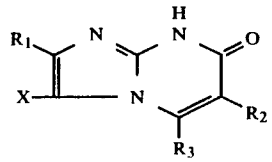
| No. | $R_1$ | $R_2$ | $R_3$ | X |
|---|---|---|---|---|
| 3-11 | $-CONHC_{12}H_{25}$ | $-H$ | $-H$ | $-Cl$ |
| 3-12 | $-SO_2N(C_8H_{17})_2$ | $-H$ | $-H$ | $-H$ |
| 3-13 | 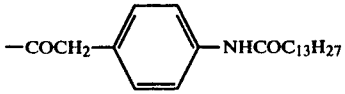 | $-H$ | $-H$ | $-Cl$ |
| 3-14 | $-H$ | $-H$ | $-OH$ | $-H$ |
| 3-15 | $-H$ | $-H$ | $-OC_{11}H_{23}$ | $-H$ |
| 3-24 | 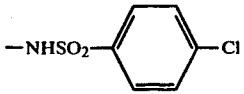 | $-Cl$ | $-CH_3$ | $-H$ |
| 3-25 | $-C(CH_3)_2CH_2SO_2C_{18}H_{37}$ | $-Cl$ | $-C_2H_5$ | $-Cl$ |
| 3-26 | $-C_{16}H_{33}$ | $-H$ | $-C(CH_3)_3$ | 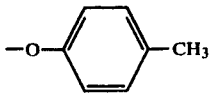 |
| 3-27 | $-NHC_6H_5$ | $-Br$ | $-C_{11}H_{23}$ | $-H$ |
| 3-28 | 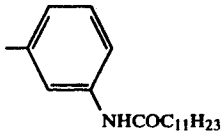 | $-Cl$ | $-CH_3$ | $-H$ |

-continued
Formula II-3
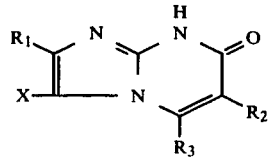
| No. | $R_1$ | $R_2$ | $R_3$ | X |
|---|---|---|---|---|
| 3-29 | 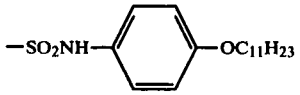 | —Cl | —$CH_3$ | —H |
| 3-30 | 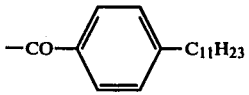 | —Cl | —$CH_3$ | —H |
| 3-16 | —$CH(CH_3)_2$ | —H | —$OC_8H_{17}$ | —Cl |
| 3-17 | 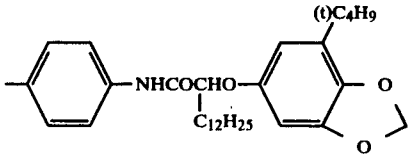 | —H | —$OCH_3$ | —Cl |
| 3-18 | 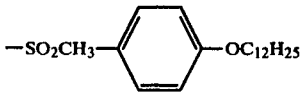 | —H | —$OC_2H_5$ | —H |
| 3-19 | —$C_{12}H_{25}$ | —H | —$OCH_3$ | —H |
| 3-20 | —$COOC_{18}H_{37}$ | —H | —$OCH_3$ | —Cl |
| 3-21 | —H | —Cl | —$CH_3$ | —Cl |
| 3-22 | —$SCH_3$ | —Cl | —$CH_3$ | —H |
| 3-23 | 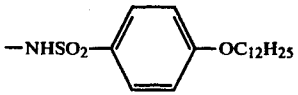 | —Cl | —$CH_3$ | —H |
| 3-31 | —H | —H | —$NHSO_2C_{16}H_{33}$ | —Cl |

-continued
Formula II-3
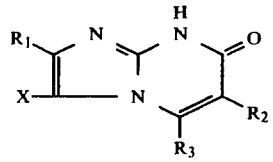
| No. | $R_1$ | $R_2$ | $R_3$ | X |
|---|---|---|---|---|
| 3-32 | $-CH_3$ | $-H$ | 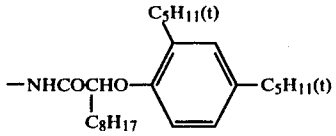 | $-Cl$ |
| 3-33 | 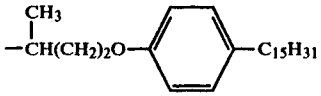 | $-H$ | $-NHCOC_4H_9$ | $-H$ |
| 3-34 | $-C(CH_3)_3$ | $-H$ | 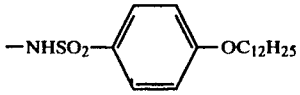 | $-Cl$ |
| 3-35 | $-C_{16}H_{33}$ | $-H$ | 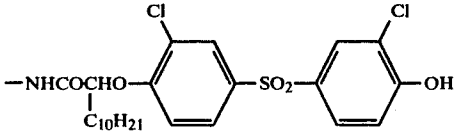 | $-H$ |
| 3-36 | $-SO_2CH_2C_6H_5$ | $-H$ | 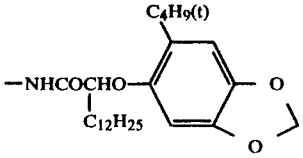 | $-H$ |
| 3-37 | $-NHCOCH_3$ | $-H$ | 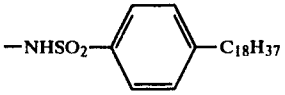 | $-Cl$ |

-continued
Formula II-3
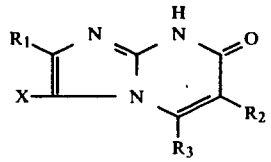
| No. | $R_1$ | $R_2$ | $R_3$ | X |
|---|---|---|---|---|
| 3-38 | 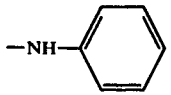 | —H | 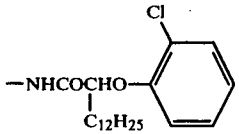 | 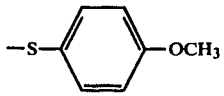 |
| 3-39 | $-OC_2H_5$ | —H | 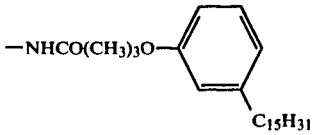 | —Cl |
| 3-40 | $-C_6H_5$ | —H | $-NHCOC_{11}H_{23}$ | —H |
| 3-41 | $-SO_2N(C_3H_7)_2$ | —H | 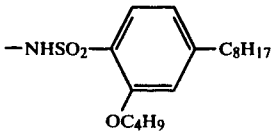 | —H |
| 3-42 | $-SO_2NHC_{12}H_{25}$ | —H | 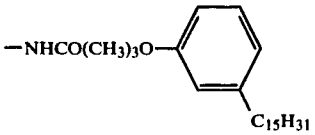 | —Cl |
| 3-43 | $-COOCH_3$ | —H | $-NHSO_2C_{16}H_{33}$ | 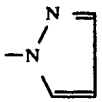 |

-continued
Formula II-3
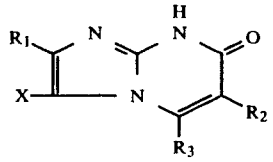
| No. | $R_1$ | $R_2$ | $R_3$ | X |
|---|---|---|---|---|
| 3-44 | $-COCH_3$ | $-H$ | 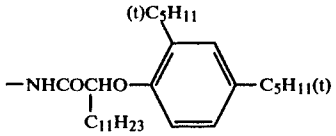 | $-H$ |
| 3-45 | 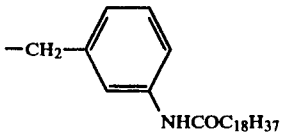 | $-H$ | $-NHCOC_2H_5$ | $-Cl$ |
| 3-46 | $-CH_3$ | $-C_2H_5$ | 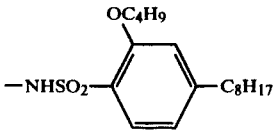 | $-Cl$ |
| 3-47 | $-C_6H_5$ | $-C_{18}H_{37}$ | 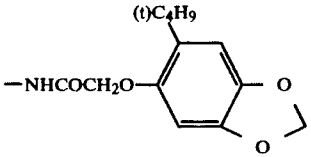 | $-H$ |
| 3-48 | $-SO_2N(CH_3)_2$ | $-H$ | 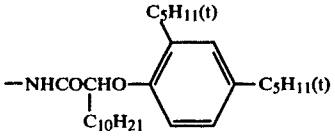 | 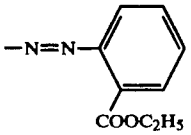 |

-continued
Formula II-3
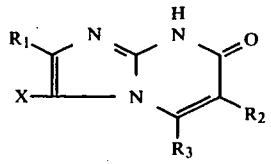
| No. | $R_1$ | $R_2$ | $R_3$ | X |
|---|---|---|---|---|
| 3-49 | $-NHCOCH_3$ | $-H$ | 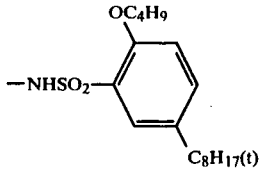 | 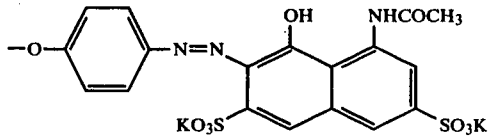 |
| 3-50 | $-C(CH_3)_3$ | $-H$ | 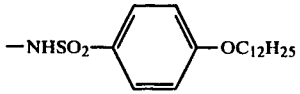 | 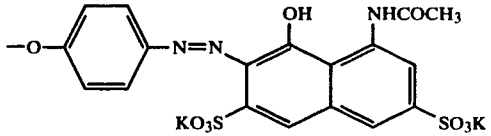 |

Formula II-4
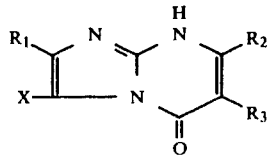
| No. | $R_1$ | $R_2$ | $R_3$ | X |
|---|---|---|---|---|
| 4-1 | —H | —$CH_3$ | —H | —H |
| 4-2 | —H | —$C_4H_9$(t) | —H | —Cl |
| 4-3 | —H | —$C_6H_5$ | —H | —H |
| 4-4 | —H | —$CO_2C_2H_5$ | —H | —H |
| 4-5 | —$C_{15}H_{31}$ | —$CH_3$ | —H | —Cl |
| 4-6 | —H | —$CH_3$ | —$CH_3$ | —H |
| 4-7 | 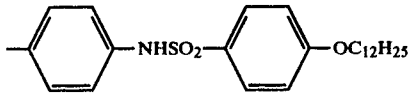 | —H | —H | —H |
| 4-8 | 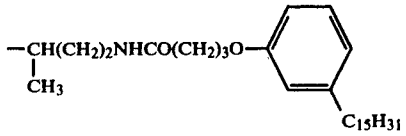 | —H | —H | —Cl |
| 4-9 | 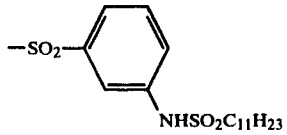 | —H | —H | —H |
| 4-10 | 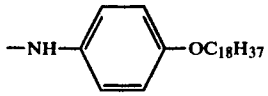 | —H | —H | —Br |
| 4-11 | —$OC_{12}H_{25}$ | —H | —H | —Cl |

-continued
Formula II-4
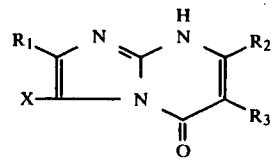
| No. | $R_1$ | $R_2$ | $R_3$ | X |
|---|---|---|---|---|
| 4-12 | 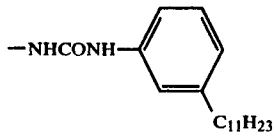 | —H | —H | —H |
| 4-13 | $-CONHC_{12}H_{25}$ | —H | —H | —Cl |
| 4-14 | $-SO_2N(C_8H_{17})_2$ | —H | —H | —H |
| 4-15 | 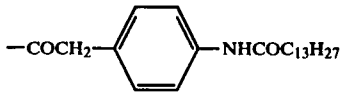 | —H | —H | —Cl |
| 4-16 | $-CH(CH_3)_2$ | —H | $-OC_8H_{17}$ | —Cl |
| 4-17 | 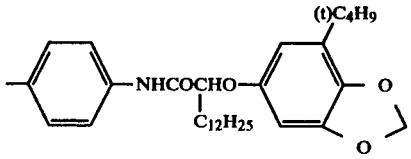 | —H | $-OCH_3$ | —Cl |
| 4-18 | 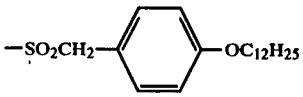 | —H | $-OC_2H_5$ | —H |
| 4-19 | $-C_{12}H_{25}$ | —H | $-OCH_3$ | —H |
| 4-20 | $-COOC_{18}H_{37}$ | —H | $-OCH_3$ | —Cl |
| 4-21 | —H | —Cl | $-CH_3$ | —Cl |
| 4-22 | $-SCH_3$ | —Cl | $-CH_3$ | —H |

-continued
Formula II-4
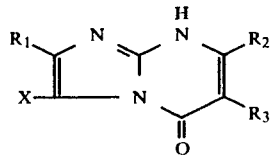
| No. | $R_1$ | $R_2$ | $R_3$ | X |
|---|---|---|---|---|
| 4-23 | $-NHSO_2-C_6H_4-OC_{12}H_{25}$ | $-Cl$ | $-CH_3$ | $-H$ |
| 4-24 | $-NHSO_2-C_6H_4-Cl$ | $-Cl$ | $-CH_3$ | $-H$ |
| 4-25 | $-C(CH_3)_2CH_2SO_2C_{18}H_{37}$ | $-Cl$ | $-C_2H_5$ | $-Cl$ |
| 4-26 | $-C_{16}H_{33}$ | $-H$ | $-C(CH_3)_3$ | $-O-C_6H_4-CH_3$ |
| 4-27 | $-NHC_6H_5$ | $-Br$ | $-C_{11}H_{23}$ | $-H$ |
| 4-28 | $-C_6H_4-NHCOC_{11}H_{23}$ | $-Cl$ | $-CH_3$ | $-H$ |
| 4-29 | $-SO_2NH-C_6H_4-OC_{11}H_{23}$ | $-Cl$ | $-CH_3$ | $-H$ |

-continued
Formula II-4
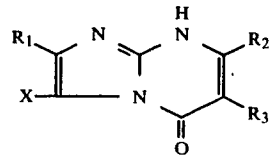
| No. | $R_1$ | $R_2$ | $R_3$ | X |
|---|---|---|---|---|
| 4-30 | 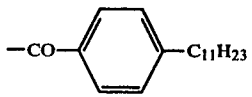 | —Cl | —$CH_3$ | —H |
| 4-31 | —H | —H | —$NHSO_2C_{16}H_{33}$ | —Cl |
| 4-32 | —$CH_3$ | —H | 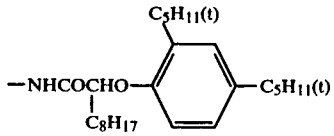 | —Cl |
| 4-33 | 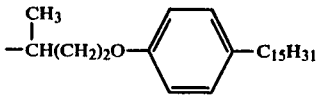 | —H | —$NHCOC_4H_9$ | —H |
| 4-34 | —$C(CH_3)_3$ | —H | 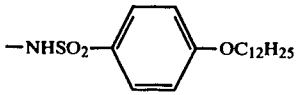 | —Cl |
| 4-35 | —$C_{16}H_{33}$ | —H | 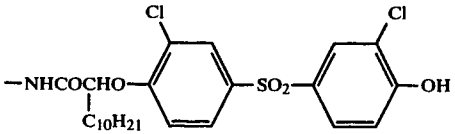 | —H |

-continued
Formula II-4
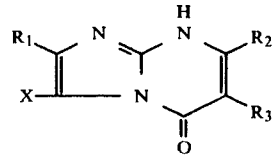
| No. | $R_1$ | $R_2$ | $R_3$ | X |
|---|---|---|---|---|
| 4-36 | $-SO_2CH_2C_6H_5$ | —H | 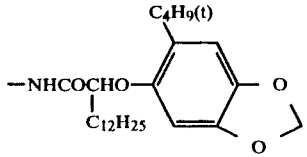 | —H |
| 4-37 | $-NHCOCH_3$ | —H | 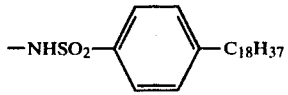 | —Cl |
| 4-38 | 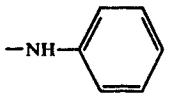 | —H | 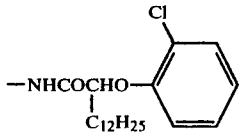 | 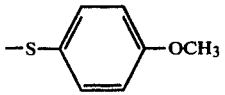 |
| 4-39 | $-OC_2H_5$ | —H | 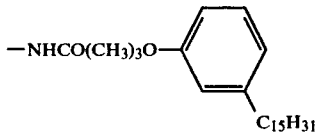 | —Cl |
| 4-40 | $-C_6H_5$ | —H | $-NHCOC_{11}H_{23}$ | —H |
| 4-41 | $-SO_2N(C_3H_7)_2$ | —H | 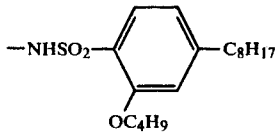 | —H |

-continued
Formula II-4
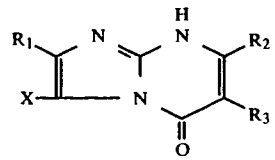
| No. | $R_1$ | $R_2$ | $R_3$ | X |
|---|---|---|---|---|
| 4-42 | $-SO_2NHC_{12}H_{25}$ | $-H$ | 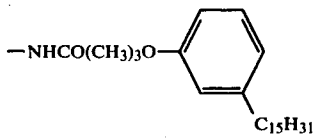 | $-Cl$ |
| 4-43 | $-COOCH_3$ | $-H$ | $-NHSO_2C_{16}H_{33}$ | 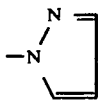 |
| 4-44 | $-COCH_3$ | $-H$ | 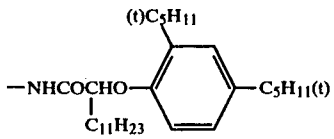 | $-H$ |
| 4-45 | 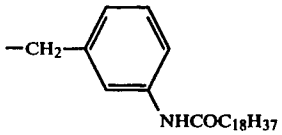 | $-H$ | $-NHCOC_2H_5$ | $-Cl$ |
| 4-46 | $-CH_3$ | $-C_2H_5$ | 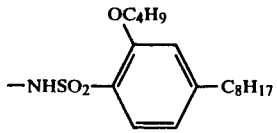 | $-Cl$ |

-continued
Formula II-4
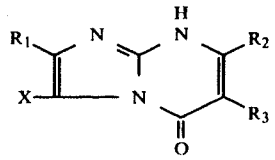
| No. | $R_1$ | $R_2$ | $R_3$ | X |
|---|---|---|---|---|
| 4-47 | $-C_6H_5$ | $-C_{18}H_{37}$ | 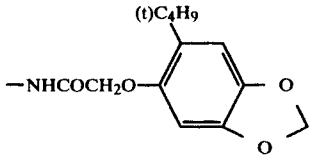 | $-H$ |
| 4-48 | $-SO_2N(CH_3)_2$ | $-H$ | 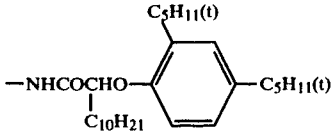 | 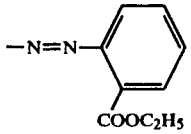 |
| 4-49 | $-NHCOCH_3$ | $-H$ | 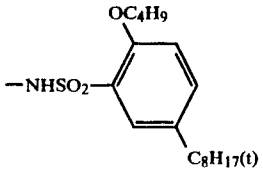 | 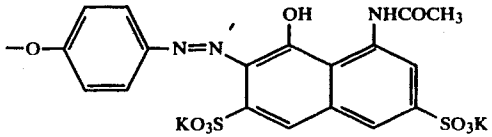 |
| 4-50 | $-C(CH_3)_3$ | $-H$ | 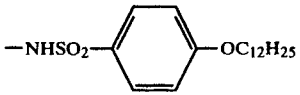 | 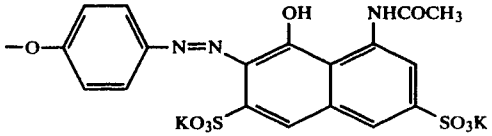 |

The above couplers of the invention include the compounds shown in Chemical and Pharmaceutical Bulletin, Vol. 31(9) 1983, PP. 2540–2551, and can be easily synthesized according to the method described therein.

In this literature cited, however, there are no descriptions suggesting that the compounds shown therein are useful as couplers for color photography.

Synthesis 1: Synthesis of Illustrated Compound 1-1

Illustrated Compound 1-1 was synthesized according to the following scheme.

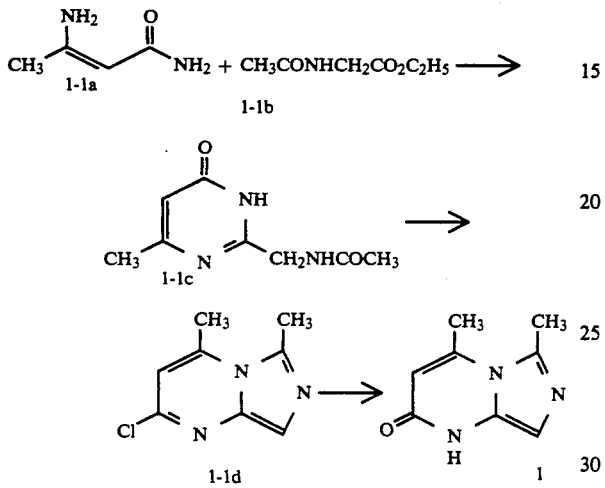

1) Synthesis of Compound 1-1c

Ten g (0.1 mol) of Compound 1-1a and 29 g (0.2 mol) of Compound 1-1b were dissolved in 96.5 ml of a 28 wt % methanol solution of sodium methoxide and refluxed for 5 hours at a boiling temperature. After completion of the reaction, the reaction mixture was neutralized with a 10% hydrochloric acid, and subsequently water and chloroform were added therein, then, the chloroform layer was taken out.

The solution was concentrated and 13.6 g (yield: 75%) of Compound 1-1c was recrystallized from a methanol-ethyl acetate mixed solvent, the melting point was 196° C. to 197° C.

2) Synthesis of Compound 1-1d

After adding 181 ml of phosphorous oxychloride to 18.1 g (0.1 mol) of Compound 1-1c, the mixture was allowed to react for 1.5 hours at 90° C. Then, excess phosphorous oxychloride was distilled out under reduced pressure, and the residue was poured into an ice-cold water, neutralized with potassium carbonate and extracted with chloroform. The solvent was then distilled out and the product was purified by column chromatography. Thus, 11.3 g (yield: 73%) of Compound 1-1d was obtained.

3) Synthesis of Illustrated Compound 1-1

There was added 250 ml of a 10% hydrochloric acid to a dioxane solution containing 9.1 g (0.05 mol) of Compound 1-1c, the reaction mixture was refluxed for 4 hours at a boiling temperature and then neutralized with a 10% aqueous solution of sodium hydroxide. After removing the solvent from the reaction system, a small amount of water was added thereto to make the product crystallize. The crude crystals obtained by filtration was further recrystallized from a methanol-ethyl acetate mixed solvent. Thus, 3.9 g (yield: 48%) of illustrated Compound 1-1 having a melting point of 265° C. to 268° C. was prepared. The structure of this compound was confirmed by NMR, IR and MASS.

Synthesis 2: Synthesis of Illustrated Compound 2-1

Illustrated Compound 2-1 was synthesized according to the following schema.

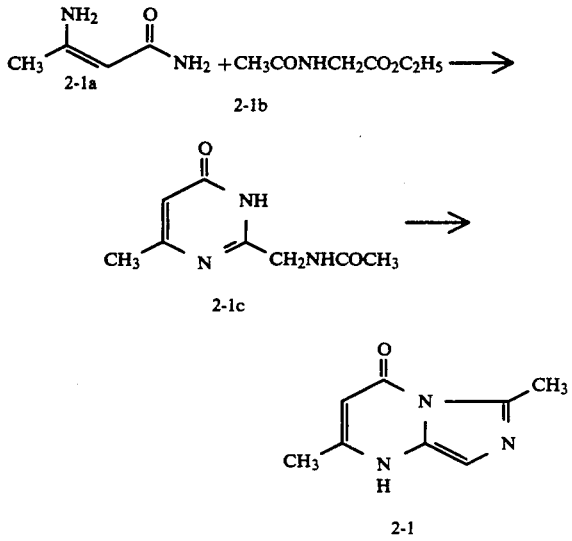

1) Synthesis of Compound 2-1c

Ten g (0.1 mol) of Compound 2-1a and 29 g (0.2 mol) of Compound 2-1b were dissolved in 96.5 ml of a 28 wt % methanol solution of sodium methoxide and refluxed for 5 hours at a boiling temperature. After completion of the reaction, the reaction mixture was neutralized with a 10% hydrochloric acid, and subsequently water and chloroform were added therein, then, the chloroform layer was taken out.

The solution was concentrated, and 13.6 g (yield: 75%) of Compound 2-1c was recrystallized from a methanol-ethyl acetate mixed solvent, the melting point was 196° C. to 197° C.

2) Synthesis of Compound 2-1

There was added 181 ml of polyphosphoric acid to 18.1 g (0.1 mol) of Compound 2-1c, and the mixture was allowed to react for 4 hours in a range of 100° C. to 110° C. After completion of the reaction, the reaction liquor was poured into an ice-cold water, neutralized with sodium carbonate and then extracted with ethyl acetate. After removing the solvent, the product was recrystallized from acetone. Thus, 11.4 g (yield: 70%) of illustrated Compound 2-1 was obtained, whose melting point was 200° C. The structure of this compound was confirmed by NMR, IR and MASS.

Synthesis 3: Synthesis of Illustrated Compound 3-1

There was dissolved 19.9 g (0.1 mol) of α-bromoacetophenone in 250 ml of ethanol, and 12.5 g (0.1 mol) of 2-amino-4-hydroxy-6-methylpyrimidine was added thereto, then the reaction liquor was boiled for 1 hour under refluxing. After completion of the reaction, the reaction liquor was cooled to room temperature and crystals formed were filtered out. Recrystallization of the product from ethanol gave 17.1 g (yield: 76%) of illustrated Compound 3-1. The structure was confirmed by NMR, IR and MASS.

Synthesis 4: Synthesis of Illustrated Compound 4-1

After adding 13.2 g (0.1 mol) of 2-aminoimidazole ½.sulfate and 14.3 g (0.11 mol) of ethyl acetoacetate to 60 ml of acetic acid, the reaction liquor was allowed to react for 5 hours under refluxing at a boiling temperature. At the termination of the reaction, 60 ml of water was added therein to make the product crystallize. Recrystallization of the crystals from water gave 10.7 g (yield: 72%) of illustrated Compound 4-1 having a melting point of 239° C. The structure of this compound was confirmed by NMR, IR and MASS.

The coupler of the invention may be used usually in a range from $1\times10^{-3}$ to 1 mol, preferably in a range from $1\times10^{-2}$ to $8\times10^{-1}$ mol per mol of silver halide.

Further, the coupler of the invention may be employed together with other types of couplers.

There can be applied methods and techniques for conventional dye-forming couplers to the coupler of the invention.

The coupler of the invention can be used as a color-photograph-forming material in any of color forming methods typically represented by the coupler-in-developer process and the coupler-in-emulsion process. When used in the coupler-in-developer process, the coupler of the invention is added to a developing bath in the form of aqueous solution or organic solvent (for example, alcohols) solution.

When used in the coupler-in-emulsion process, the coupler of the invention is contained in a photographic light-sensitive material as a color-photograph-forming material.

Typically, the coupler of the invention is mixed in a silver halide emulsion, and then the emulsion is coated on a support to from a color light-sensitive material. The coupler of the invention is used, for example, in color photographic light-sensitive materials such as color negative film and color positive film as well as color photographic paper.

The light-sensitive material employing the coupler of the invention including color photographic paper may be a monochromic one or a polychromic one. In a polychromic light-sensitive material, although the coupler of the invention may be contained in any layer, it is usually contained in a red-sensitive silver halide emulsion layer. A polychromic light-sensitive material has dye-image-forming structural units in respective spectral regions of primary three colors. Each structural unit may comprise a single emulsion layer or multiple emulsion layers which have a light-sensitivity to a specific spectral region. The light-sensitive material's structural layers, including the layers of dye-image-forming structural units, may be configured in various orders as known in the art. A typical polychromic light-sensitive material is that which comprises a support bearing thereon a cyan-dye-image-forming structural unit comprising at least one red-sensitive silver halide emulsion layer containing at least one cyan coupler (at least one of the cyan couplers is a coupler of the invention), a magenta-dye-image-forming structural unit comprising at least one green-sensitive silver halide emulsion layer containing at least one magenta coupler, and a yellow-dye-image-forming structural unit comprising at least one blue-sensitive silver halide emulsion layer containing at least one yellow coupler.

The light-sensitive material may have additional layers such as filter layer, intermediate layer, protective layer or subbing layer. In incorporating the coupler of the invention in an emulsion, conventional methods will do. For example, a silver halide emulsion usable in the invention can be prepared by dissolving the coupler of the invention singly or in combination in one of or, if necessary, in a mixture of high boiling solvents having boiling points higher than 175° C. such as tricresyl phosphate and dibutyl phthalate or low boiling solvents such as butyl acetate and butyl propionate, mixing the solution with an aqueous gelatin solution containing a surfactant, and then emulsifying the mixture with a high speed rotary mixer or a colloid mill.

The silver halide composition suitable for a light-sensitive material using the coupler of the invention includes silver chloride, silver chlorobromide and silver chloroiodobromide. Further, it may be a combined one such as a mixture of silver chloride and silver bromide. In other wards, a particularly rapid developability is needed of a silver halide emulsion used in color photographic paper; accordingly, it is preferable that the silver halide composition contain chlorine atoms. Particularly preferred silver halide compositions are such silver chlorides, silver chlorobromides and silver chloroiodobromides as contain at least 1% of silver chloride.

These silver halide emulsions are chemically sensitized according to a conventional method, or may be spectrally sensitized to a desired wavelength region.

In order to prevent fog and/or to keep photographic properties stable in the course of manufacture, storage, and photographic processing of these light-sensitive materials, there may be added to a silver halide emulsion a compound known as an antifoggant or stabilizer in the art.

The color light-sensitive material using the coupler of the invention may contain an antistain agent, dye image stabilizer, UV absorbent, antistatic agent, matting agent and surfactant, which are usually employed in light-sensitive materials.

These additives are referred to, for example, in Research Disclosure, Vol. 176 (December, 1978), pp. 22–31.

The color photographic light-sensitive material using the coupler of the invention can form dye images when subjected to color development in a manner known in the art.

Further, the color photographic light-sensitive material using the coupler of the invention can be made to contain a color developing agent itself or a precursor thereof in the hydrophilic colloid layer so as to be processed in an alkaline activating bath.

After color development, the color photographic light-sensitive material using the coupler of the invention is subjected to a bleaching process and a fixing process. The bleaching process may be made concurrently with the fixing process.

After the fixing process, a washing process follows in general. But a stabilizing process may be carried out instead of the washing process, or these two processes may be done concurrently.

EXAMPLES

Example 1

Sample 1 of red-sensitive color light-sensitive material was prepared by forming the following layers in sequence on a paper support laminated with polyethylene on both sides. The addition amounts of the compounds are per $m^2$ unless otherwise specified, the addition amounts of silver halide are given in amounts of silver present.

1st Layer: Emulsion Layer

A red-sensitive emulsion layer comprising 1.2 g of gelatin, 0.30 g of a red-sensitive silver chlorobromide emulsion (silver chloride content: 96 mol %) and $9.1\times10^{-4}$ mol of comparative cyan coupler A dissolved in 1.35 g of dioctyl phosphate.

2nd Layer: Protective Layer

A protective layer containing 0.50 g of gelatin. As a hardener, sodium 2,4-dichloro-6-hydroxy-s-triazine was added so as to be an addition amount of 0.017 g per gram of gelatin.

Next, samples 2 to 28 of the invention were prepared in the same manner as in sample 1, except that comparative coupler A was replaced in turn by one of the couplers shown in Table 1, the addition amounts were the same as that of comparative coupler A.

Samples 1 to 29 prepared as above were each subjected to exposure through an optical wedge and processed as described below.

| Processing | | |
|---|---|---|
| Color developing | 38° C. | 3 min and 30 sec |
| Bleach-fixing | 38° C. | 1 min and 30 sec |
| Stabilizing/or washing | 25° C. to 30° C. | 3 min |
| Drying | 75° C. to 80° C. | 2 min |

Compositions of the processing solutions used in the respective processes.

| | |
|---|---|
| (Color developer) | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N-ethyl-N-(β-methanesulfonamidethyl)aniline sulfate | 5.5 g |
| Fluorescent brightener (4,4'-diaminostilbene-disulfonic acid derivative) | 1.0 g |
| Potassium hydroxide | 2.0 g |
| Water was added to make up to 1 liter, then the pH is adjusted to 10.20. | |
| (Bleach-fixer) | |
| Ammonium ferric ethylenedimainetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |

The pH is adjusted to 7.1 with potassium carbonate or glacial acetic acid, and water is added to make up to 1 liter.

| (Stabilizer) | |
|---|---|
| 5-Chloro-2-methyl-4-iosthiazoline-3-one | 1.0 g |
| Ethylene glycol | 10 g |
| Water was added to make up to 1 liter. | |

Samples 1 to 29 processed as above were evaluated for the reflex density with a Densitometer Model KD-7R (product of Konica Corp.). These processed samples were also allowed to stand for 14 days in the environment of 60° C. and 80% RH to evaluate the heat resistance and moisture resistance of the dye image.

Further, after irradiating each sample for 10 days with a xenon fade-o-meter, the density was measured to evaluate the light fastness. The results are shown in Table 1, where the heat resistance, moisture resistance and light fastness of the dye image are given in percentages of residual dye after the heat resistance, moisture resistance and light fastness tests relative to the initial density 1.0.

Comparative coupler A

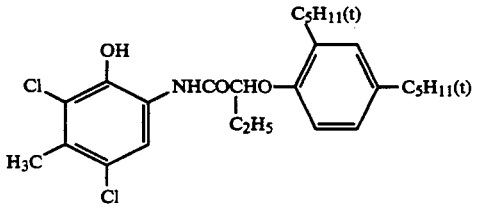

TABLE 1

| Sample No. | Coupler used | Rate of residual dye (%) Heat & moisture resistance | Light fastness |
|---|---|---|---|
| 1 | Comparison A | 62 | 83 |
| 2 | 1-4 | 90 | 82 |
| 3 | 1-5 | 88 | 84 |
| 4 | 1-19 | 88 | 83 |
| 5 | 1-23 | 91 | 86 |
| 6 | 1-25 | 89 | 88 |
| 7 | 1-34 | 92 | 85 |
| 8 | 1-40 | 93 | 81 |
| 9 | 2-5 | 87 | 82 |
| 10 | 2-7 | 88 | 84 |
| 11 | 2-19 | 89 | 83 |
| 12 | 2-23 | 90 | 86 |
| 13 | 2-25 | 90 | 87 |
| 14 | 2-34 | 93 | 85 |
| 15 | 2-42 | 93 | 83 |
| 16 | 3-4 | 89 | 85 |
| 17 | 3-6 | 83 | 84 |
| 18 | 3-11 | 89 | 83 |
| 19 | 3-16 | 92 | 84 |
| 20 | 3-23 | 89 | 88 |
| 21 | 3-36 | 94 | 84 |
| 22 | 3-42 | 90 | 84 |
| 23 | 4-5 | 90 | 81 |
| 24 | 4-12 | 87 | 86 |
| 25 | 4-20 | 89 | 83 |
| 26 | 4-28 | 89 | 84 |
| 27 | 4-34 | 90 | 87 |
| 28 | 4-36 | 93 | 86 |
| 29 | 4-37 | 94 | 82 |

Example 2

Sample 31 of red-sensitive color light-sensitive material was prepared by forming the following layers in sequence on a subbed cellulose triacetate film support. The addition amounts of the compounds and the silver halide emulsion are described in the same manner as in Example 1.

1st Layer: Emulsion Layer

A red-sensitive emulsion layer comprising 1.4 g of gelatin, 1.50 g of a red-sensitive silver iodobromide emulsion (silver iodide content: 4 mol %) and $8.0\times10^{-4}$ mol of comparative cyan coupler B dissolved in 1.1 g of tricresyl phosphate.

2nd Layer: Protective Layer

A protective layer containing 1.5 g of gelatin. As a hardener, sodium 2,4-dichloro-6-hydroxy-s-triazine was added so as to give an addition amount of 0.017 g per gram of gelatin.

Next, samples 32 to 55 of the invention were prepared in the same manner as in sample 31, except that comparative coupler B was replaced in turn by one of the couplers shown in Table 2, the addition amounts were the same as that of comparative coupler B.

The film samples obtained as above were wedgewise exposed in an usual manner and color-developed according to the following procedure.

Comparative coupler B

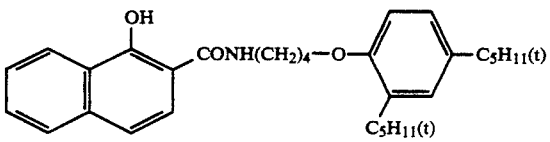

| Processing (Processing temp. 38° C.) | Processing time |
|---|---|
| Color developing | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |
| Drying | |

Composition of the processing solution used in each process is as follows:

| | |
|---|---|
| (Color developer) | |
| 4-Amino-3-methyl-N-ethyl-N-(β-hydroxyethyl)-aniline sulfate | 4.75 g |
| Anhydrous sodium sulfite | 4.25 g |
| Hydroxylamine ½.sulfate | 2.0 g |
| Anhydrous potassium carbonate | 37.5 g |
| Sodium bromide | 1.3 g |
| Trisodium nitriletriacetate monohydrate | 2.5 g |
| Potassium hydroxide | 1.0 g |
| Water is added to make up to 1 liter, and the pH is adjusted to 10.6 with sodium hydroxide. | |
| (Bleaching solution) | |
| Ammonium ferric ethylene diamine tetraacetate | 100.0 g |
| Diammonium ethylenediaminetetraacetate | 10.0 g |
| Ammonium bromide | 150.0 g |
| Glacial acetic acid | 10.0 g |
| Water is added to make up to 1 liter, and the pH is adjusted to 6.0 with an aqueous ammonia. | |
| (Fixer) | |
| Ammonium thiosulfate | 175.0 g |
| Anhydrous sodium sulfite | 8.6 g |
| Sodium metasulfite | 2.3 g |
| Water is added to make up to 1 liter, and the pH is adjusted to 6.0 with acetic acid. | |
| (Stabilizer) | |
| Formalin (37% solution) | |
| Konidax (product of Konica Corp.) | 7.5 ml |
| Water is added to make up to 1 liter. | |

Samples 31 to 55 processed as above were evaluated for the transmition density with a Densitometer Model KD-7R (product of Konica Corp.). These processed samples were also allowed to stand for 14 days in the environment of 60° C. and 80% RH to evaluate the heat resistance and moisture resistance of the dye image.

Further, after irradiating each sample for 10 days with a xenon fade-o-meter, the density was measured to evaluate the light fastness. The results are shown in Table 2, where the heat resistance, moisture resistance and light fastness of the dye image are given in percentages of residual dye after the heat resistance, moisture resistance and light fastness tests relative to the initial density 1.0.

TABLE 2

| | | Rate of residual dye (%) | |
|---|---|---|---|
| Sample No. | Coupler used | Heat & moisture resistance | Light fastness |
| 31 | Comparison B | 73 | 81 |
| 32 | 1-7 | 83 | 80 |
| 33 | 1-11 | 89 | 81 |
| 34 | 1-20 | 92 | 81 |
| 35 | 1-30 | 85 | 83 |
| 36 | 1-36 | 94 | 85 |
| 37 | 1-42 | 91 | 83 |
| 38 | 1-44 | 89 | 84 |
| 39 | 2-4 | 82 | 80 |
| 40 | 2-11 | 88 | 81 |
| 41 | 2-20 | 91 | 80 |
| 42 | 2-30 | 86 | 82 |
| 43 | 2-33 | 90 | 85 |
| 44 | 2-40 | 91 | 83 |
| 45 | 2-44 | 90 | 85 |
| 46 | 3-8 | 81 | 80 |
| 47 | 3-19 | 86 | 81 |
| 48 | 3-25 | 91 | 81 |
| 49 | 3-30 | 85 | 83 |
| 50 | 3-34 | 94 | 84 |
| 51 | 3-37 | 91 | 82 |
| 52 | 3-40 | 90 | 84 |
| 53 | 4-11 | 85 | 79 |
| 54 | 4-13 | 87 | 83 |
| 55 | 4-16 | 92 | 81 |
| 56 | 4-23 | 87 | 82 |
| 57 | 4-30 | 92 | 84 |
| 58 | 4-40 | 89 | 83 |
| 59 | 4-42 | 87 | 85 |

Example 3

Samples 61 to 81 of red-sensitive color reversal photographic light-sensitive material were prepared by forming the following layers in sequence on a triacetyl cellulose film support.

1st Layer: Emulsion Layer

A red-sensitive emulsion layer comprising 1.4 g of gelatin, 0.5 g of a red-sensitive silver iodobromide emulsion (silver chloride content: 96 mol %) and $9.1\times10^{-4}$ mol of the coupler described in Table 3 dissolved in 1.5 g of dibutyl phthalate.

2nd Layer: Protective Layer

A protective layer containing 0.5 g of gelatin. As a hardener, sodium 2,4-dichloro-6-hydroxy-s-triazine was added so as to give an addition amount of 0.017 g per gram of gelatin.

The samples obtained as above were wedgewise exposed in an usual manner and color-developed according to the following procedure.

| | (Reversal processing) | |
|---|---|---|
| Process | Processing time | Processing temp. |
| 1st developing | 6 min | 38° C. |
| Washing | 2 min | 38° C. |
| Reversing | 2 min | 38° C. |

-continued

| Process | (Reversal processing) Processing time | Processing temp. |
|---|---|---|
| Color developing | 6 min | 38° C. |
| Conditioning | 2 min | 38° C. |
| Bleaching | 6 min | 38° C. |
| Fixing | 4 min | 38° C. |
| Washing | 4 min | 38° C. |
| Stabilizing | 1 min | 38° C. |
| Drying | | Ordinary temperature |

Compositions of the processing solutions are as follows:

| | |
|---|---|
| (1st developer) | |
| Sodium tetrapolyphosphate | 2 g |
| Sodium sulfite | 20 g |
| Hydroquinone.monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (1% solution) | 2 ml |
| Water to make up to | 1,000 ml |
| (Reversing solution) | |
| Hexasodium nitrilotrimethylene phosphonate | 3 g |
| Stannous chloride (dihydrate) | 1 g |
| p-Aminophenol | 0.1 g |
| Sodium hydroxide | 5 g |
| Glacial acetic acid | 15 ml |
| Water to make up to | 1,000 ml |
| (Color developer) | |
| Sodium tetrapolyphosphate | 2 g |
| Sodium sulfite | 7 g |
| Sodium tertiary phosphate (dodecahydrate) | 36 g |
| Potassium bromide | 1 g |
| Potassium iodide (0.1% solution) | 90 ml |
| Sodium hydroxide | 3 g |
| Citrazinic acid | 1.5 g |
| N-Ethyl-N-(β-methanesulfonamidethyl)-3-methyl-4-aminaniline sulfate | 11 g |
| Ethylenediamine | 3 g |
| (Conditioner) | |
| Sodium sulfite | 12 g |
| Disodium ethylenediaminetetraacetate dihydrate | 8 g |
| Thioglycerol | 0.4 ml |
| Glacical acetic acid | 3 ml |
| Water is added to make up to | 1,000 ml |
| (Bleaching solution) | |
| Disodium ethylenediaminetetraacetate dihydrate | 2.0 g |
| Ammonium ferric ethylenediamine-tetraacetate dihydrate | 120.0 g |
| Potassium bromide | 100.0 g |
| Water is added to make up to | 1,000 ml |
| (Fixer) | |
| Sodium thiosulfate | 80.0 g |
| Sodium sulfite | 5.0 g |
| Sodium bisulfate | 5.0 g |
| Water is added to make up to | 1,000 ml |
| (Stabilizer) | |
| Formalin (37 wt % solution) | 5.0 ml |
| Konidax (product of Konica Corp.) | 5.0 ml |
| Water is added to make up to | 1,000 ml |

Samples processed as above were evaluated for the heat & moisture resistance and light fastness of the dye images in the same manner as in Example 2. The results are shown in Table 3.

TABLE 3

| Sample No. | Coupler used | Rate of residual dye (%) Heat & moisture resistance | Light fastness |
|---|---|---|---|
| 61 | Comparison A | 61 | 83 |
| 62 | 1-3 | 89 | 82 |
| 63 | 1-16 | 91 | 83 |
| 64 | 1-28 | 88 | 84 |
| 65 | 1-33 | 88 | 83 |
| 66 | 1-37 | 92 | 83 |
| 67 | 2-3 | 90 | 82 |
| 68 | 2-16 | 90 | 83 |
| 69 | 2-28 | 89 | 83 |
| 70 | 2-33 | 89 | 84 |
| 71 | 2-37 | 92 | 84 |
| 72 | 3-7 | 90 | 83 |
| 73 | 3-20 | 89 | 82 |
| 74 | 3-28 | 87 | 83 |
| 75 | 3-33 | 91 | 84 |
| 76 | 3-44 | 92 | 85 |
| 77 | 4-7 | 92 | 81 |
| 78 | 4-19 | 89 | 84 |
| 79 | 4-25 | 89 | 82 |
| 80 | 4-33 | 90 | 84 |
| 81 | 4-47 | 92 | 83 |

It is understood from Tables 1 to 3 that the samples employing the couplers of the invention have residual dye rates higher than those of the samples using the comparative couplers, that is, the samples according to the invention have heat & moisture resistances and light-fastnesses superior to those of the comparative samples.

What is claimed is:

1. A silver halide color photographic light-sensitive material comprising a support having thereon a silver halide emulsion layer containing a coupler represented by the formula (I-1) defined below

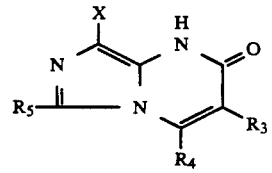

(I-1)

wherein $R_3$, $R_4$ and $R_5$ are each a hydrogen atom or a substituent; X is a hydrogen atom or a substituent capable of splitting off upon reaction with the oxidation product of a color developing agent.

2. A silver halide color photographic light-sensitive material comprising a support having thereon a silver halide emulsion layer containing a coupler represented by the formula (I-2) defined below

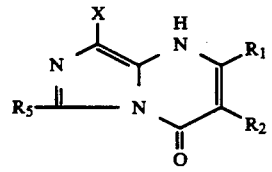

(I-2)

wherein $R_1$, $R_2$ and $R_5$ are each a hydrogen atom or a substituent; X is a hydrogen atom or a substituent capable of splitting off upon reaction with the oxidation product of a color developing agent.

3. A silver halide color photographic light-sensitive material comprising a support having thereon a silver halide emulsion layer containing a coupler represented by the formula (I-3) defined below

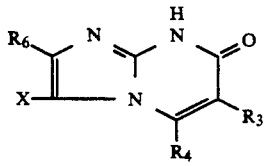

(I-3)

wherein $R_3$, $R_4$ and $R_6$ are each a hydrogen atom or a substituent; X is a hydrogen atom or a substituent capable of splitting off upon reaction with the oxidation product of a color developing agent.

4. A silver halide color photographic light-sensitive material comprising a support having thereon a silver halide emulsion layer containing a coupler represented by the formula (I-4) defined below

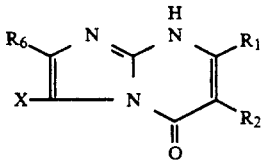

(I-4)

wherein $R_1$, $R_2$ and $R_6$ are each a hydrogen atom or a substituent; X is a hydrogen atom or a substituent capable of splitting off upon reaction with the oxidation product of a color developing agent.

5. A light-sensitive material of claim 1, 2, 3 or 4 wherein said coupler is contained in said silver halide emulsion layer in an amount of from $1\times10^{-3}$ mol to 1 mol per mol of silver halide contained in said silver halide emulsion layer.

6. A light-sensitive material of claim 5, wherein said coupler is contained in said silver halide emulsion layer in an amount of from $1\times10^{-2}$ mol to $8\times10^{-1}$ mol per mol of silver halide contained in said silver halide emulsion layer.

7. A light-sensitive material of claim 1, 2, 3 or 4 wherein said coupler is contained in a red-sensitive silver halide emulsion layer.

8. A light-sensitive material of claim 1, 2, 3 or 4 wherein $R_1$, $R_2$, $R_3$ and $R_4$ are each an alkyl group, an aryl group, a carboxyl group, an oxycarbonyl group, a cyano group, a hyroxyl group, an alkoxy group, an aryloxy group, an amino group, a sulfonamido group, a hydrogen atom or a halogen atom.

* * * * *